US007942545B2

(12) United States Patent
Kassay et al.

(10) Patent No.: US 7,942,545 B2
(45) Date of Patent: May 17, 2011

(54) BALLAST ACCESS HATCH IN REFLECTOR

(75) Inventors: Charles E. Kassay, Smithtown, NY (US); Suzanne M. Pane, Yaphank, NY (US); Marc A. Kassay, Wake Forest, NC (US); John Peter Kassay, Wake Forest, NC (US)

(73) Assignee: Philips Electronics North America Corporation, Burlington, MA (US)

( * ) Notice: Subject to any disclaimer, the term of this patent is extended or adjusted under 35 U.S.C. 154(b) by 294 days.

(21) Appl. No.: 12/229,390

(22) Filed: Aug. 22, 2008

(65) Prior Publication Data

US 2010/0046215 A1 Feb. 25, 2010

(51) Int. Cl.
*F21V 23/02* (2006.01)

(52) U.S. Cl. ..... 362/221; 362/217.05; 362/225; 362/260

(58) Field of Classification Search ..... 362/221, 362/225, 217.05, 260
See application file for complete search history.

(56) References Cited

U.S. PATENT DOCUMENTS

| | | | | | |
|---|---|---|---|---|---|
| 2,327,231 | A | | 8/1943 | Westcott | |
| 2,332,770 | A | * | 10/1943 | Abernathy | 362/221 |
| 2,348,930 | A | | 5/1944 | Schepmoes | |
| 2,433,819 | A | | 12/1947 | Scribner | |
| 2,474,308 | A | | 6/1949 | Franck | |
| 2,474,341 | A | | 6/1949 | Wince | |
| 2,532,528 | A | | 12/1950 | Zuley | |
| 2,545,058 | A | | 3/1951 | Walsh | |
| 2,567,779 | A | | 9/1951 | Mitchell | |
| 2,619,583 | A | | 11/1952 | Baumgartner | |
| 2,641,433 | A | | 6/1953 | Wright | |
| 2,642,251 | A | | 6/1953 | Janness | |
| 2,736,528 | A | | 2/1956 | Le Brock | |
| 2,936,991 | A | | 5/1960 | Picha | |
| 4,138,716 | A | | 2/1979 | Muhlethaler | |
| 4,191,989 | A | | 3/1980 | Page | |
| 4,220,986 | A | | 9/1980 | Matteo | |
| 4,674,015 | A | | 6/1987 | Smith | |
| 5,143,467 | A | * | 9/1992 | Gardner | 403/24 |
| 5,274,533 | A | * | 12/1993 | Neary et al. | 362/225 |
| 5,371,661 | A | | 12/1994 | Simpson | |
| 5,523,931 | A | | 6/1996 | Kassay | |
| 5,528,473 | A | | 6/1996 | Kassay | |
| 5,806,967 | A | | 9/1998 | Scorus | |
| 5,988,829 | A | | 11/1999 | Holder | |
| 6,024,468 | A | | 2/2000 | Kassay | |
| 6,102,550 | A | | 8/2000 | Edwards | |
| 6,210,018 | B1 | | 4/2001 | Kassay | |
| 6,428,183 | B1 | | 8/2002 | McAlpin | |
| 6,619,815 | B2 | * | 9/2003 | Southern, Jr. | 362/225 |
| 7,070,303 | B2 | | 7/2006 | Kassay | |
| 7,500,762 | B2 | | 3/2009 | Kassay et al. | |
| 2003/0058640 | A1 | * | 3/2003 | McAlpin | 362/225 |

* cited by examiner

*Primary Examiner* — Stephen F Husar
*Assistant Examiner* — James W Cranson
(74) *Attorney, Agent, or Firm* — Alfred M. Walker

(57) ABSTRACT

A hatch is provided for a fluorescent lighting fixture having a continuous reflector covering the central section. The hatch is covered by a cover of compatible contour cut through the reflector underneath the location of the ballast in the housing above the reflector. The hatch cover is finished in the same surface as that of the reflector to minimize any disruption to the intended reflective pattern and to blend visually with the reflector. Two or more preferably quick-connect fasteners attach the hatch cover to the reflector. To gain access to the ballast, the lens or diffuser is removed and then the fluorescent lamp tubes which would interfere with the hatch cover are removed. The hatch cover is then removed to gain unobstructed access to the ballast from the underside of the fixture.

3 Claims, 2 Drawing Sheets

BALLAST ACCESS HATCH IN REFLECTOR

FIELD OF THE INVENTION

The present invention relates to accessible hatches for ballasts of fluorescent light fixtures.

BACKGROUND OF THE INVENTION

Fluorescent light fixtures using tubular lamps are common and efficient. One or more ballasts are required in each fixture to operate the lamps. Access to these ballasts during assembly and for later servicing or replacement is required. For some fixtures with separate reflector wings emanating from a central housing, a long narrow housing cover is removable to gain access to the ballast from the underside.

U.S. Pat. No. 6,102,550 of Edwards, Jr. shows a ballast built into an end bracket which also supports the lamp sockets in a fluorescent fixture. Access is from the underside with shorter reflectors permitting such access. U.S. Pat. No. 4,674,015 of Smith shows a removable ballast accessible from the side of the housing above the reflector. U.S. Pat. No. 4,220,986 of Matteo et al. describes a hinged ballast tray which swings out of a rectangular luminaire after a glazed door is opened.

Some fluorescent light fixtures for one or more tubular lamps use carefully shaped contoured reflectors to achieve specific patterns of lighting as their objective. Kassay, in U.S. Pat. No. 7,070,303 shows several fixtures with careful attention to the amount of uplighting emanating from the edge of the reflector. In these fluorescent fixtures, the central section of the fixture has a continuous reflector.

OBJECTS OF THE INVENTION

Therefore, it is a desirable object to be able to access the ballast of a fluorescent fixture from the underside, without removing the reflector, even if the reflector is continuous over the central section.

SUMMARY OF THE INVENTION

In the present invention, a fluorescent lighting fixture with a continuous reflector covering the central section has a hatch covered by a cover of compatible contour cut through the reflector underneath the location of the ballast in the housing above the reflector. The hatch cover is finished in the same surface as that of the reflector to minimize any disruption to the intended reflective pattern and to blend visually with the reflector. At least one quick release fastener, preferably two or more preferably quick-connect fasteners (such as quarter-turn types) attach the hatch cover to the reflector.

The procedure for gaining access to the ballast is to remove the lens or diffuser (if used) and then to remove any fluorescent lamp tubes that interfere with the hatch cover. The hatch cover is then removed to gain unobstructed access to the ballast. This is conveniently accomplished from the underside of the fixture even if a continuous reflector is used.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
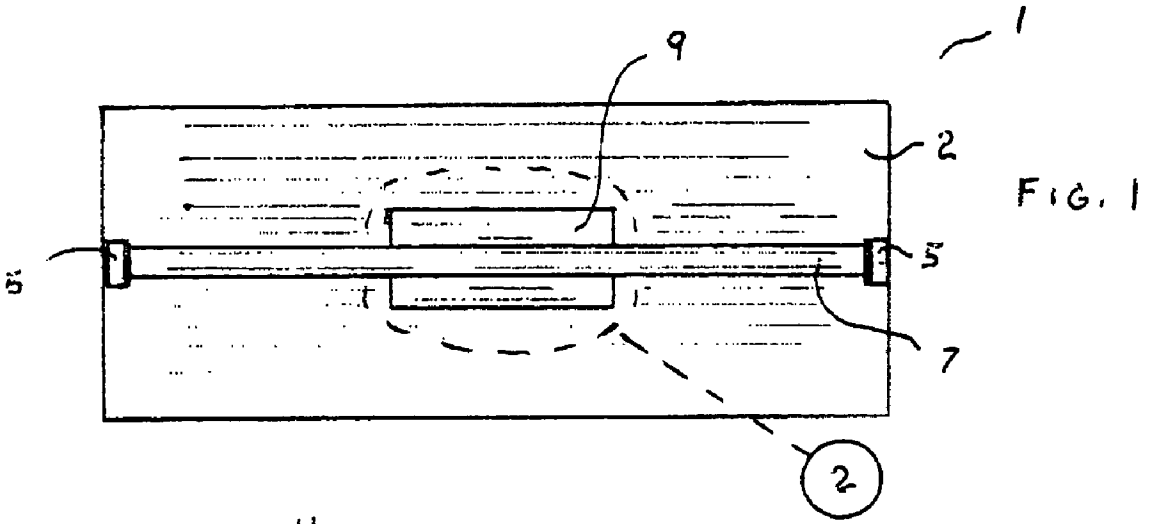
FIG. 1 is a bottom plan view of a fluorescent fixture with a single tubular lamp, a continuous reflector, and a covered ballast access hatch of this invention.
Figure 3:
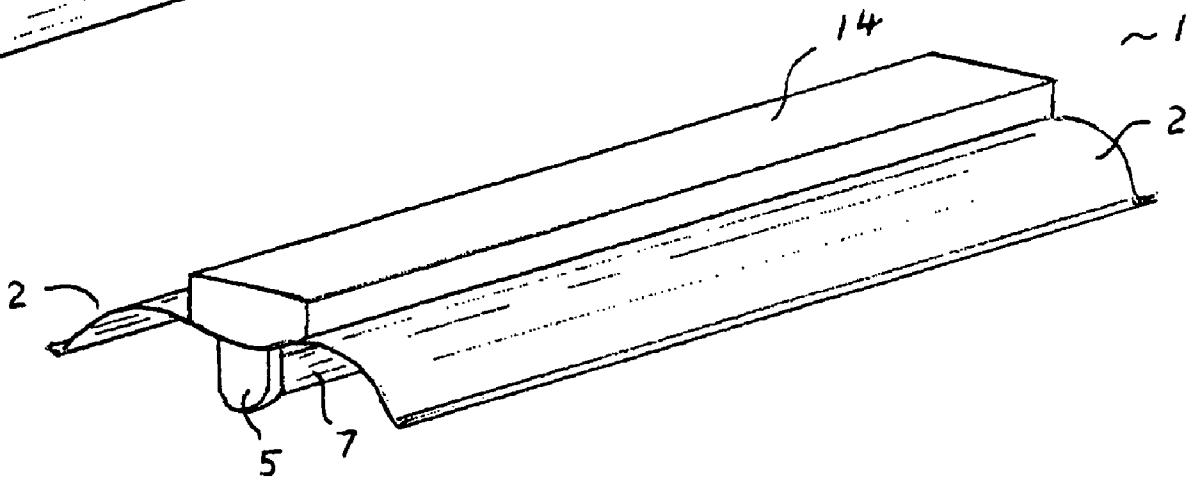
FIG. 3 is a perspective view of the lighting fixture of FIG. 1 showing the wiring/ballast housing as well as the continuous reflector contour.

Fixture 1 shown in FIGS. 1 and 3, shows a single lamp 7 in sockets 5 with a continuous contoured reflector 2 which covers the bottom surface of wiring and ballast housing 14. Hatch cover 9 over the ballast access hatch cut in reflector 2 is shown under lamp 7.

Figure 2:
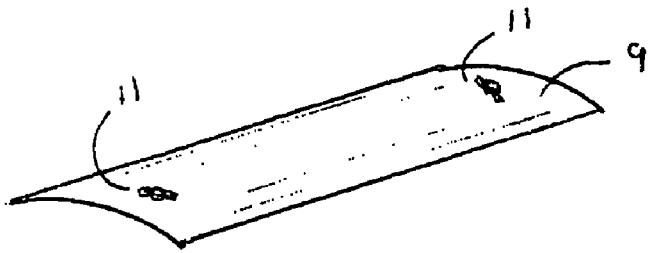
FIG. 2 is a perspective view of the convex hatch cover of FIG. 1.

Convex contoured hatch cover 9 is shown in FIG. 2 with captive quarter-turn fasteners 11. Note that this matches the central contour of reflector 2. The visible surface of hatch cover 9 also matches that of reflector 2; this may be polished metal, white paint, or some other finish. Although the hatch and cover 9 are shown in the center of fixture 1 in FIG. 1, the placement could be longitudinally offset to match the placement of a non-centrally located ballast in housing 14.

Figure 4:
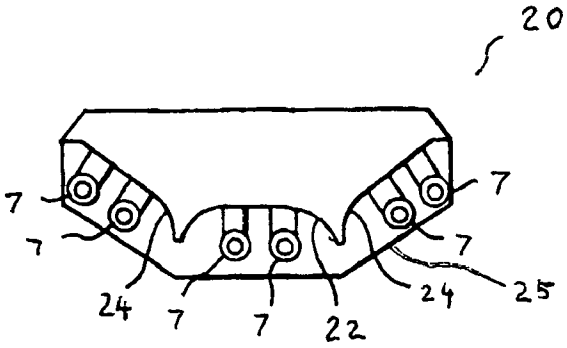
FIG. 4 is an end view of a multi-lamp fluorescent lighting fixture of this invention.
Figure 5:
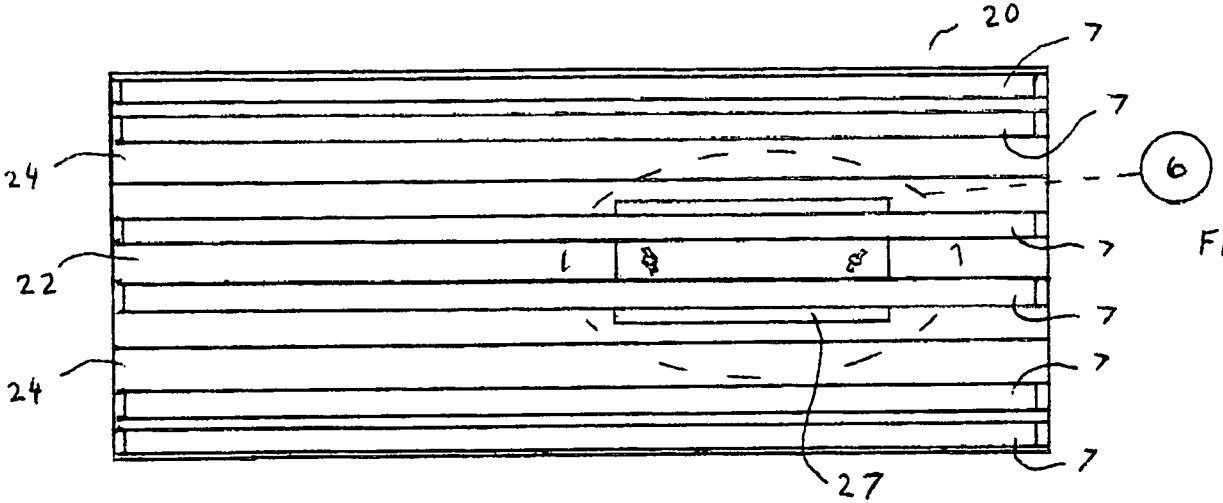
FIG. 5 is a bottom plan view of the six lamp fixture of FIG. 4 showing the hatch cover of this invention.
Figure 6:
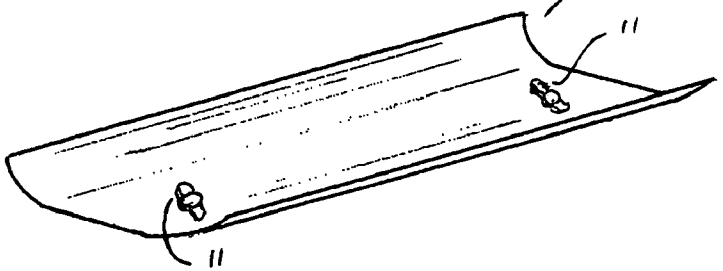
FIG. 6 is a perspective view of the concave hatch cover compatible with the reflector of FIG. 4.

FIGS. 4-6 show a hatch installation for a multi-lamp fixture.

For example, the end view of FIG. 4 reveals a six lamp 7 fixture 20 with a continuous reflector in three sections, 24 on each side and 22 in the center. A lens or diffuser contour 25 is shown over lamps 7.

FIG. 5 shows a bottom view of fixture 20 with the lens or diffuser removed (if any) to reveal the lamps 7 and reflector sections 22 and 24. Hatch cover 27 under two lamps 7 and somewhat offset (under the ballast, not shown) is illustrated.

The hatch cover 27 detail of FIG. 6 reveals that this cover is concave as is the central portion of reflector 22.

Any fluorescent lamp fixture using a continuous reflector can benefit from this invention to provide easy access to a ballast from the underside of the fixture.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A fluorescent light fixture having a ballast located behind a removable lens and one or more removable lamps and a continuous reflector covering a central section comprising:

said continuous reflector covering the central section having a hatch covered by a cover of compatible contour cut through the reflector underneath the location of the ballast in the housing above the reflector;

said hatch cover being finished in the same surface as that of the reflector to minimize any disruption to the intended reflective pattern and to blend visually with the reflector;

at least one quick-connect fastener attaching said hatch cover to the reflector;

wherein to gain access to the ballast said lens and said lamps are removed to access said hatch cover; and, said hatch cover being removable to gain unobstructed access to the ballast.

2. The light fixture of claim 1 wherein said batch cover is located between said lamp and said reflector, whereby removal of said lamp allows access to said hatch cover.

3. The light fixture of claim 1 wherein said fastener is rotatable for a quarter-turn to lock and unlock said hatch cover in place.

* * * * *